United States Patent [19]

Yamada

[11] Patent Number: 4,993,475

[45] Date of Patent: Feb. 19, 1991

[54] DIE FOR GOLF CLUB HEAD

[75] Inventor: Magoichi Yamada, Tokyo, Japan

[73] Assignee: Daiwa Golf Co., Ltd., Tokyo, Japan

[21] Appl. No.: 479,457

[22] Filed: Feb. 13, 1990

[30] Foreign Application Priority Data

Feb. 28, 1989 [JP] Japan ..... 1-47643

[51] Int. Cl.[5] ..... B22D 17/26; B22D 33/04

[52] U.S. Cl. ..... 164/340; 164/342; 249/184

[58] Field of Search ..... 164/340, 341, 342, 369, 164/312; 249/175, 177, 184

[56] References Cited

FOREIGN PATENT DOCUMENTS 54-11830 1/1979 Japan ..... 164/340
55-88950 7/1980 Japan ..... 164/340
61-33970 10/1986 Japan .

*Primary Examiner*—Kuang Y. Lin
*Attorney, Agent, or Firm*—Kalish & Gilster

[57] ABSTRACT

The present invention relates to a golf club having a hollow head and to a golf club head die to cast such a hollow golf club head. The golf club head of this invention has a hollowly formed head and a golf club shaft which is inserted through this hollow part. Further, in the golf club head die of the present invention, a shaft hole pin is arranged through the insert core, and its one end is inserted into the positioning hole formed in one of divided die members. Still further, in the golf club head die of this invention, after casting of the head body, the insert core piece at the center is removed through the opening in the sole and the other insert core pieces around it are moved to the position of this removed insert core piece to be removed through the opening.

2 Claims, 4 Drawing Sheets

DIE FOR GOLF CLUB HEAD

BACKGROUND OF THE INVENTION

1. Field of the Invention

The present invention relates to a golf club provided with a hollow head and to a die for golf club head to cast a hollow golf club head.

2. Description of the Prior Art

Conventionally, hollow club heads made of metals were manufactured by precision casting called lost wax process which uses wax material, or the method disclosed in Japanese Utility Model Application Laid-open Print No. 61-33970, where a hollow head body is formed by joining three pieces into one.

However, in this method disclosed in Utility Model Application Laid-open Print No. 61-33970, a divided piece is provided with a fixed pipe for shaft mounting resulting in heavy weight, and division into three pieces cause errors during manufacturing process, for example, in the position of shaft hole in relation with the face, which impedes providing of precise golf club head.

In conventional lost wax method, it was relatively difficult to obtain a uniform head and to position a shaft hole with high precision.

Further, in conventional golf clubs made of metal materials, the golf shafts were inserted through the neck to heel of the head body. However, since the path for golf shaft insertion was formed as a solid part, it was quite difficult to improve precision of shaft hole position, and to reduce the club weight.

SUMMARY OF THE INVENTION

An object of the present invention is to provide golf clubs which can be easily made lighter in weight.

Another object of the present invention is to provide golf clubs which have improved position precision of shaft holes.

Another object of the present invention is to provide golf clubs which enable manufacture of high-precision golf club heads at a reasonable cost.

Still another object of the present invention is to provide dies for golf club heads which enable manufacture of high-precision golf club heads at a reasonable cost.

And, a further object of the present invention is to provide a golf club head die comprising insert core pieces easily removable after head casting.

DESCRIPTION OF THE PREFERRED EMBODIMENT OF THE INVENTION

Figure 1:
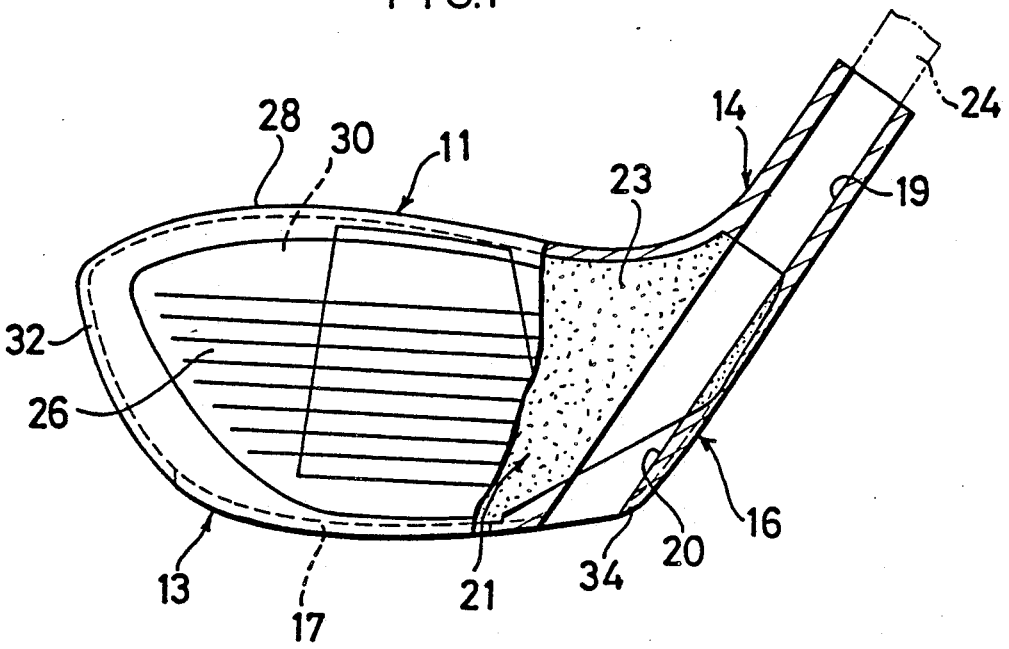
FIG. 1 is a partially longitudinal section showing one embodiment of golf club according to the present invention.
Figure 2:
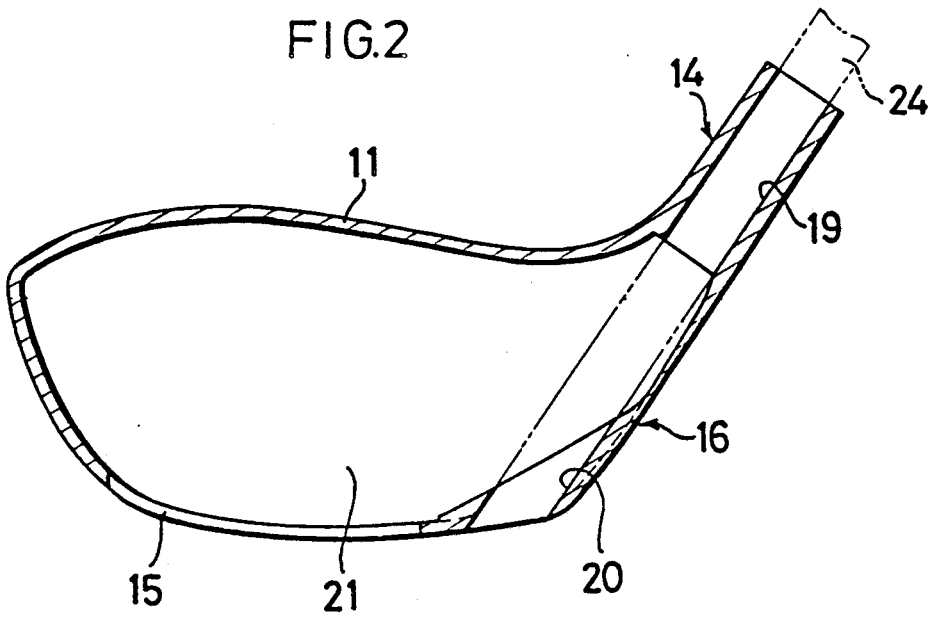
FIG. 2 is a longitudinal section showing the body of the golf club head in FIG. 1.

Embodiments of the present invention will be described in detail with reference to the attached drawings. FIG. 1 and FIG. 2 show one embodiment of the golf club according to the present invention. In these figures, reference numeral 11 shows a head body which is hollow and made of metal, and comprises a neck 14, a face 26, a top 28, a back face 30, a toe 32, a heel 16 and a shaft receptacle 34 of a sole 13 formed as one piece.

The head body 11 is provided with an opening 15 formed in the sole 13, and this opening 15 is covered with a sole plate 17.

Shaft holes 19 and 20 are formed through the neck 14 and the heel 16 of the head body 11, and hollow part 21 of the head body 11 contains filler 23.

Thus, this golf club is provided with a golf shaft 24 straightly inserted through the shaft hole 19, hollow part 21 and the other shaft hole 20.

The golf club shaft structured as described above is manufactured by inserting the golf shaft 24 through the shaft hole 19, hollow part 21 and the other shaft hole 20, fixing the shaft to the head body 11, filling the head with the filler 23 from the opening 15 and then fixing the sole plate 17 to cover the opening 15.

In the golf club structured as described above, since the head body 11 is formed hollow and the golf shaft 24 is inserted through this hollow part 21, the part which has heretofore been solid is replaced with the hollow part 21. This facilitates weight reduction and improvement in position precision of the shaft holes 19 and 20.

The golf club shaft 24 is supported by the shaft hole 19 in the neck 14 and the other shaft hole 20 in the heel 16, and can be sufficiently supported.

The golf club head body 11 structured as above can be easily manufactured only by using the die for golf club head described below when considering removal of the insert core.

Figure 3:
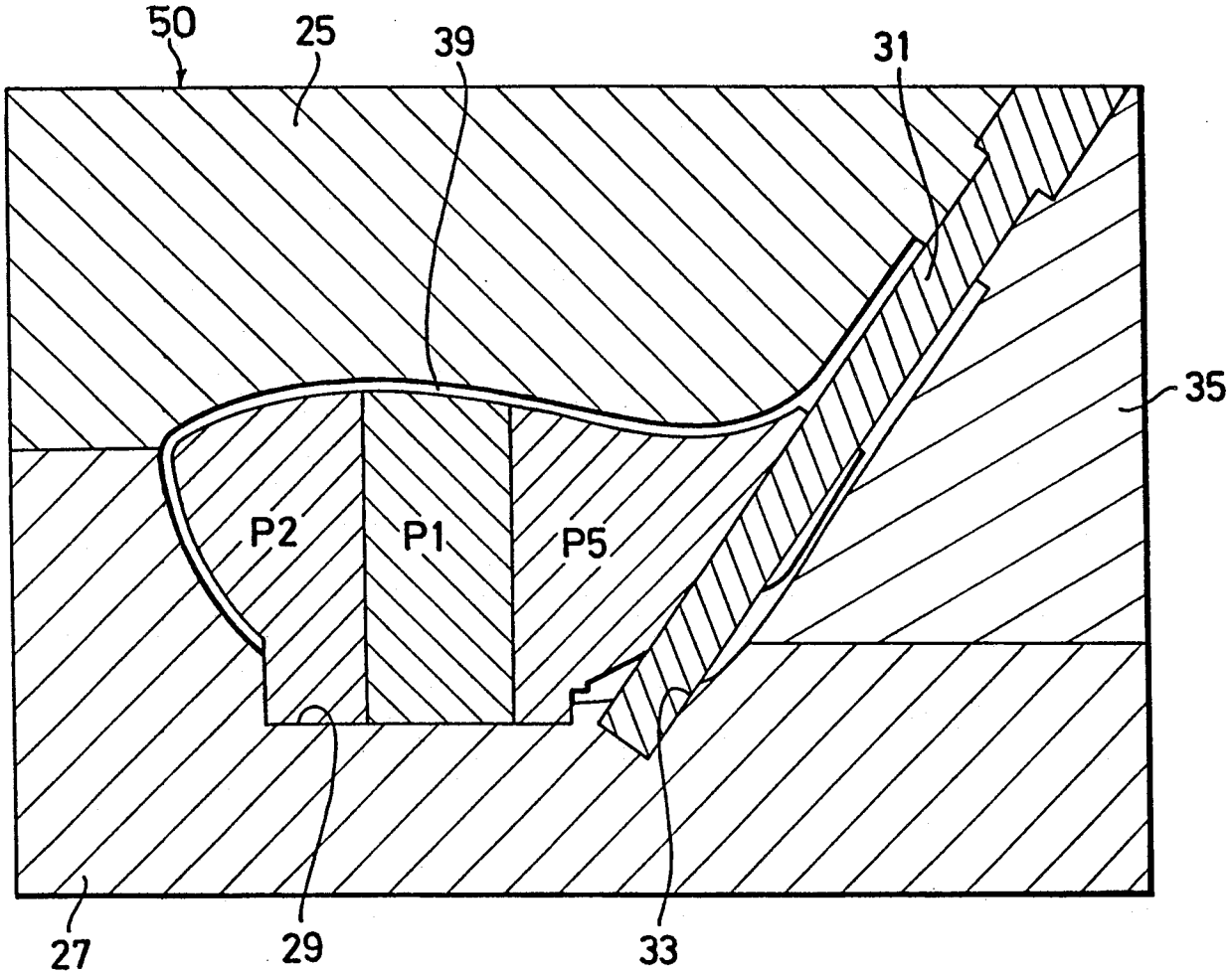
FIG. 3 is a longitudinal section showing one embodiment of the die for golf club head according to the present invention, taken on line III—III of FIG. 5.
Figure 4:
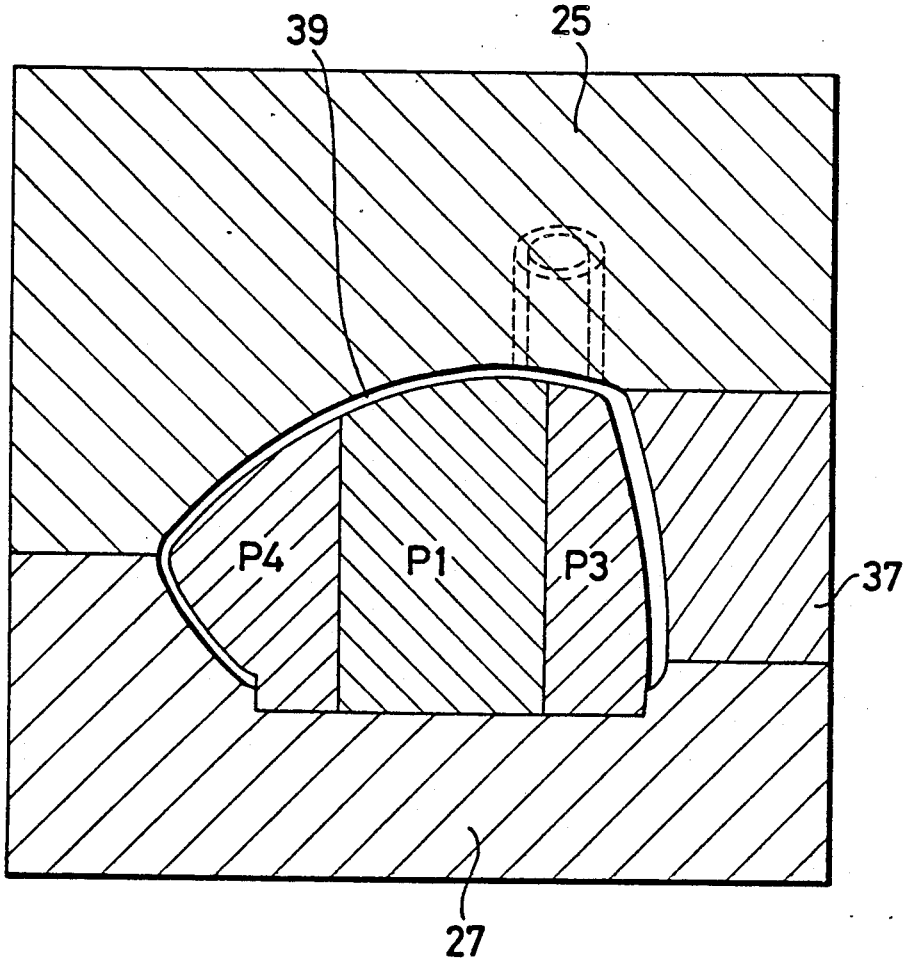
FIG. 4 is a longitudinal section of the die shown in FIG. 3 taken on line IV—IV of FIG. 5.

FIG. 3 and FIG. 4 show one embodiment of golf club head die to cast the head body 11 for above golf club head. In these figures, reference numeral 50 shows the die which is divided into upper die 25 and lower die 27 used to form a hollow head body 11 with an opening 15 in the sole 13 as mentioned before. And reference numeral 35 shows a lateral die arranged on the hosel side, and 37 shows a lateral die placed on the face side.

At the position to form the hollow part of the head body 11 in the die 50, the insert core divided into six pieces P1, P2, P3, P4, P5, and P6 is arranged.

These insert core pieces P1, P2, P3, P4, P5, and P6 mate a groove-shaped insert core receptacle 29 formed at the top of the lower die 27.

Shaft hole pin 31 is arranged through the upper die 25 and insert core piece P5, and one end of this shaft hole pin 31 is inserted into a positioning hole 33 formed at the lower die 27.

Figure 5:
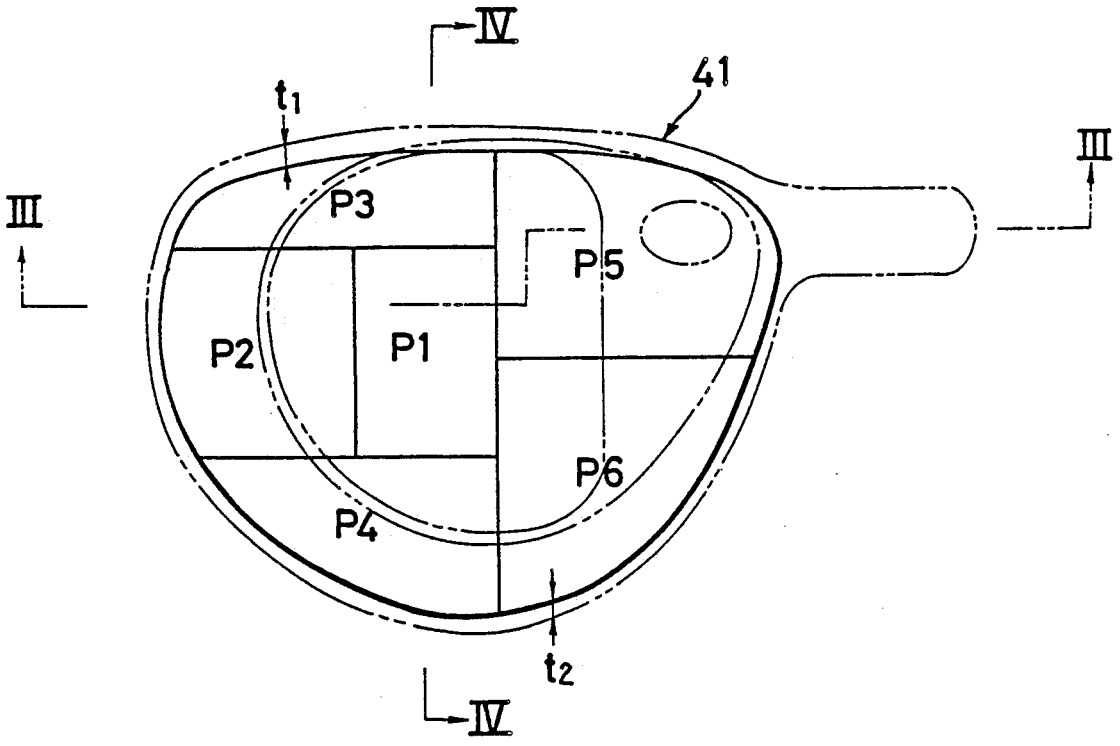
FIG. 5 is an explanatory view showing details of the insert core shown in FIG. 1.

In this embodiment, the insert core is divided into 6 (P1, P2, P3, P4, P5, and P6) as shown in FIG. 5. After casting of the head body 11, the insert core piece P1 placed at the center is removed through the opening in the sole 13, and then the insert core pieces P2, P3, P4, P5, and P6 arranged around the P1 are moved to the position of the removed P1, for example in the order of P2, P3, P4, P5, and P6 to enable removal through the opening 15.

In the golf club head die structured as described above, these insert core pieces P1, P2, P3, P4, P5 and P6 are first inserted to the insert core receptacle 29 of the lower die 27, and the upper die 25 is placed and then, the shaft hole pin 31 is inserted through the upper die 25 and the insert core P5. By inserting the end of this shaft hole pin 31 into the positioning hole 33 formed in the lower die 27, desired space 39 is formed among the upper die 25, lower die 27 and insert core pieces P1, P2, P3, P4, P5, and P6.

Then, after providing molten metal in this space 39 and curing it, the shaft hole pin 31 is pulled out of the die, the upper die 25 and the lower die 27 are separated and the cast head body 11 is taken out, and then by removing the insert core pieces P1, P2, P3, P4, P5, and P6 from the head body 11 as described above, the aforementioned head body 11 can be obtained.

The golf club head die structured as above consists of a set of die 50 divided into the upper die 25 and the lower die 27 to form a hollow head body 11 provided with an opening 15 in the sole 13, insert core pieces P1, P2, P3, P4, P5, and P6 placed at a position in the die 50 to form a hollow part of the head body 11, and shaft hole pin 31 arranged through the upper die 25 and insert core piece P5 and one end of which is inserted into positioning hole 3 formed in the lower die 27, thereby enabling the manufacture of high precision golf club head at a reasonable cost.

In the golf club head die structured as described above, since the shaft hole pin 31 is arranged through the upper die 25 and the insert core piece P5, and one end of the pin is inserted into the positioning hole 33 formed in the lower die 27, the die shaft hole pin 31 is arranged at a desired position of the upper die 25 and the lower die 27 with high precision, which considerably improves the position precision of the relation between the shaft hole 19 and the head body 11.

As a result, as shown in FIG. 5, for example, face 41 of the head body 11 can be easily provided with a thickness t1 greater than conventional ones and thickness t2 of other parts except shaft receptacle thinner than the thickness of the face 41. Less thickness for the entire head can be realized to make the weight lighter.

In the golf club head die structured as described above, since the shaft hole pin 31 is inserted through the insert core piece P5, these insert core pieces P1, P2, P3, P4, P5, and P6 can be arranged at desired positions of the upper die 25 and the lower die 27 with high precision, which enables providing uniform and high precision, or light-weight and highly sophisticated golf club head.

Further, since the golf club head structured as described above has the insert core divided into six pieces (P1, P2, P3, P4, P5, and P6), when the casting of head body 11 is completed, the insert core piece P1 at the center is removed through the opening 15 in the sole 13, and then the remaining insert core pieces P2, P3, P4, P5, and P6 placed around P1 can be consequently moved to the position of the removed insert core piece P1, for example, in the order of P2, P3, P4, P5, and P6, that enables easy removal through the opening 15.

Division of the insert core into the pieces P1, P2, P3, P4, P5, and P6 facilitates the dealing of more complicated internal shape of the head body 11.

In the above embodiment, the insert core is divided into six pieces P1, P2, P3, P4, P5, and P6, but the present invention is not limited to such an embodiment. It is naturally understood that the insert core may be divided into 6 pieces or more.

Further, in the above embodiment, the die is structured with the upper die 25 and the lower die 27, but the present invention is not limited to such a structure. For example, it can be divided into three pieces or more, or can be divided into right and left dies.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A golf club head die comprising a die divided into at least two pieces to form a hollow head body provided with an opening in the sole, insert core placed at a position in said die to make a hollow part of said head body, and a shaft hole pin which pierces through at least said insert core and is inserted into a positioning hole formed in one of said divided dies.

2. A golf club head die according to claim 1, wherein the insert core is divided into at least six pieces, enabling removal of the insert core pieces by removing the insert core piece positioned at the center from the opening in the sole after casting of the head body and by moving other insert core pieces around the center piece to the position of said removed insert core piece to be removed through the opening.

* * * * *